United States Patent [19]

Dorow et al.

[11] Patent Number: 4,622,895

[45] Date of Patent: Nov. 18, 1986

[54] SWIVEL FRAME APPARATUS FOR LINING A WRAP-AROUND PLATE ABOUT A FORM CYLINDER

[75] Inventors: Joachim Dorow, Hassloch; Gerhard Bleckmann, Lampertheim, both of Fed. Rep. of Germany

[73] Assignee: BASF Aktiengesellschaft, Ludwigshafen, Fed. Rep. of Germany

[21] Appl. No.: 777,678

[22] Filed: Sep. 19, 1985

[30] Foreign Application Priority Data

Sep. 21, 1984 [DE] Fed. Rep. of Germany ..... 3434670

[51] Int. Cl.[4] ..... B41F 9/00; B41F 5/00

[52] U.S. Cl. ..... 101/153; 101/216

[58] Field of Search ..... 101/216, 212, 142, 248, 101/174, 375, DIG. 12, 151–153

[56] References Cited

U.S. PATENT DOCUMENTS

| | | | |
|---|---|---|---|
| 3,347,159 | 10/1967 | Altonji et al. | 101/375 X |
| 3,598,050 | 8/1971 | Thompson | 101/216 |
| 3,625,145 | 12/1971 | Heatley, Jr. | 101/212 |
| 3,789,757 | 2/1974 | Motter et al. | 101/153 |
| 4,046,070 | 9/1977 | Halley | 101/216 |
| 4,137,843 | 2/1979 | Uttenhue | 101/153 |
| 4,346,655 | 8/1982 | Suter et al. | 101/153 |
| 4,503,771 | 3/1985 | Herzel | 101/216 x |
| 4,552,067 | 11/1985 | Gollinger | 101/216 |
| 4,572,069 | 2/1986 | Schwarzbeck | 101/216 X |

*Primary Examiner*—E. H. Eickholt

*Attorney, Agent, or Firm*—Keil & Weinkauf

[57] ABSTRACT

An apparatus for lining a form cylinder for gravure printing with a wrap-around plate is characterized by a machine frame having insertion apertures (3) provided in the area of its side walls (2) and allocated to the lateral journals (4) of the form cylinder (5), and having a swivel frame (10) which is pivotably mounted outside the insertion apertures (3), can be fixed relative to the machine frame and accommodates a drivable pressing roller (7) mounted in rotatable eccentric bushes. In this way, the wrap-around plate can be rolled onto the form cylinder, so that a full, uniform seating of the wrap-around plate on the cylinder periphery is ensured even when the form cylinder possesses no adjustable clamping device.

13 Claims, 2 Drawing Figures

SWIVEL FRAME APPARATUS FOR LINING A WRAP-AROUND PLATE ABOUT A FORM CYLINDER

Figure 1:
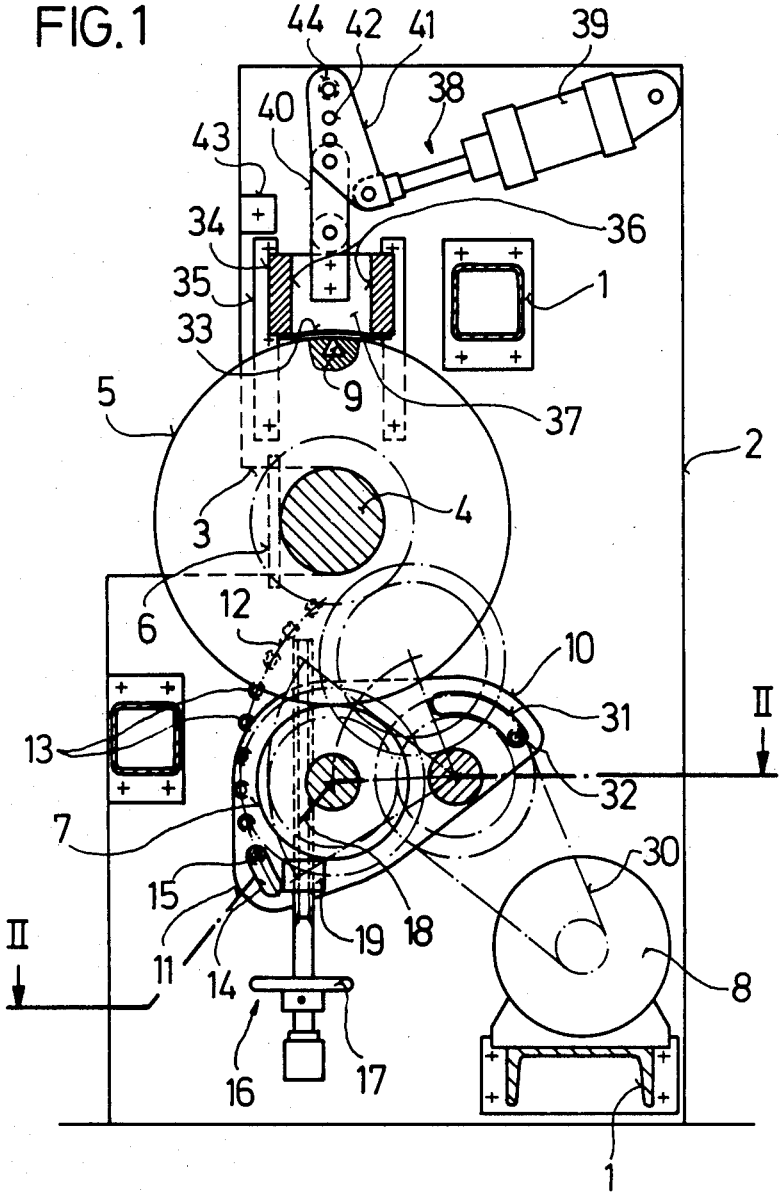

The present invention relates to an apparatus for lining a removable form cylinder, in particular a form cylinder for gravure printing, with a wrap-around plate.

The wrap-around plate must sit tightly and uniformly on the cylinder periphery to avoid migration of ink under the wrap-around plate and tumbling movements of the wrap-around plate and thus, in the case of a form cylinder for gravure printing, stressing of the cavity filling. In order to ensure this, clamping apparatuses provided in the area of the cylinder cavity were previously proposed which enable the plate, suspended by its edges into the cavity side edges, to be retightened with high force. However, clamping apparatuses of this type prove very expensive. In the case of simpler clamping apparatuses it is not possible to retighten the wrap-around plate or not with such a high force that the plate sits uniformly on the periphery.

Proceeding on this basis, it is therefore the object of the present invention, avoiding the previous disadvantages, to provide an apparatus of the type mentioned at the beginning which permits the use of simple clamping devices in which retightening of the wrap-around plate is either completely impossible or is only possible with a comparatively small force, but at the same time to ensure a full, uniform seating of the wrap-around plate on the cylinder periphery.

We have found that this object is achieved, according to the invention, by the use of a machine frame having insertion apertures, provided in the area of its side walls and allocated to the lateral journals of the form cylinder, and having a swivel frame which is pivotably mounted outside the insertion apertures, can be fixed in every required pivotal position relative to the machine frame and accommodates a drivable pressing roller mounted in rotatable eccentric bushes.

These measures in practice enable the wrap-around plate to be rolled onto the cylinder periphery, that is clamping of the plate by a rolling operation. In this way, reliable seating of the plate on the cylinder periphery is achieved. In this connection, it is at the same time possible in an advantageous manner to push the plate, by its ends, into an allocated stationary slot of the clamping device or to hold the plate in the clamped condition until an adjustable jaw of the clamping device has been readjusted. By virtue of the fact that the drivable pressing roller is accommodated on a swivel frame, easy adjustability of the pressing roller to any desired diameter of the form cylinder is obtained in an advantageous manner. Moreover, by means of the adjustable eccentric bushes, the required contact pressure can additionally be set, so that, despite various form cylinder diameters and thus contact surfaces of various size, the same surface pressure can be achieved in each case. The measures according to the invention therefore ensure that there are no limitations whatsoever with regard to the diameter of the form cylinder which can be used, but rather each cylinder diameter can be used in the same way.

In an advantageous further development of the generic measures, in each case several threaded holes arranged on a pitch circle with respect to the axis of rotation of the swivel frame can be provided in the area of the machine frame side walls, to which threaded holes is allocated an elongated hole provided in the area of each lateral bearing plate of the swivel frame and arranged on the same pitch circle, the length of which elongated hole is greater than the distance between two adjacent threaded holes. These measures permit in an advantageous manner an infinitely variable setting of the swivel frame and thus an infinitely variable format setting.

To facilitate handling, the swivel frame can be pivotable by means of a lifting device.

A further measure, particularly to be preferred, can be that the eccentric bushes rotatably mounted on the bearing plate side and accommodating the lateral bearing journals of the pressing roller are each provided with a gear rim which engages in a pinion fixed on a spindle forming the swivel axis of the swivel frame and rotatably mounted on the machine frame side. These measures, despite the adjustability of the swivel frame and thus of the pressing roller to any desired form cylinder diameter, permit the use of a regulating spindle for setting the required contact pressure, which regulating spindle is stationary on the machine frame side, and thus produce in an advantageous manner a very compact arrangement and one which is very easy to operate.

In a further, expedient embodiment of the generic measures, the pressing roller can be drivable by means of a pinion which is keyed onto a lateral bearing journal and meshes with a spur gear which is rotatably mounted on the spindle forming the axis of rotation of the swivel frame and can be driven by means of a motor fixed on the machine frame side. Despite the adjustability of the swivel frame accommodating the pressing roller and despite additional adjustability of the contact force, these measures enable the drive motor allocated to the pressing roller to be arranged in a stationary manner on the machine frame side.

A further expedient measure may consist in the fact that the pressing roller has a rubber jacket. This not only gives excellent protection of the wrap-around plate to be mounted, but at the same time enables inaccuracies of the wrap-around plate to be compensated in an advantageous manner.

Figure 2:
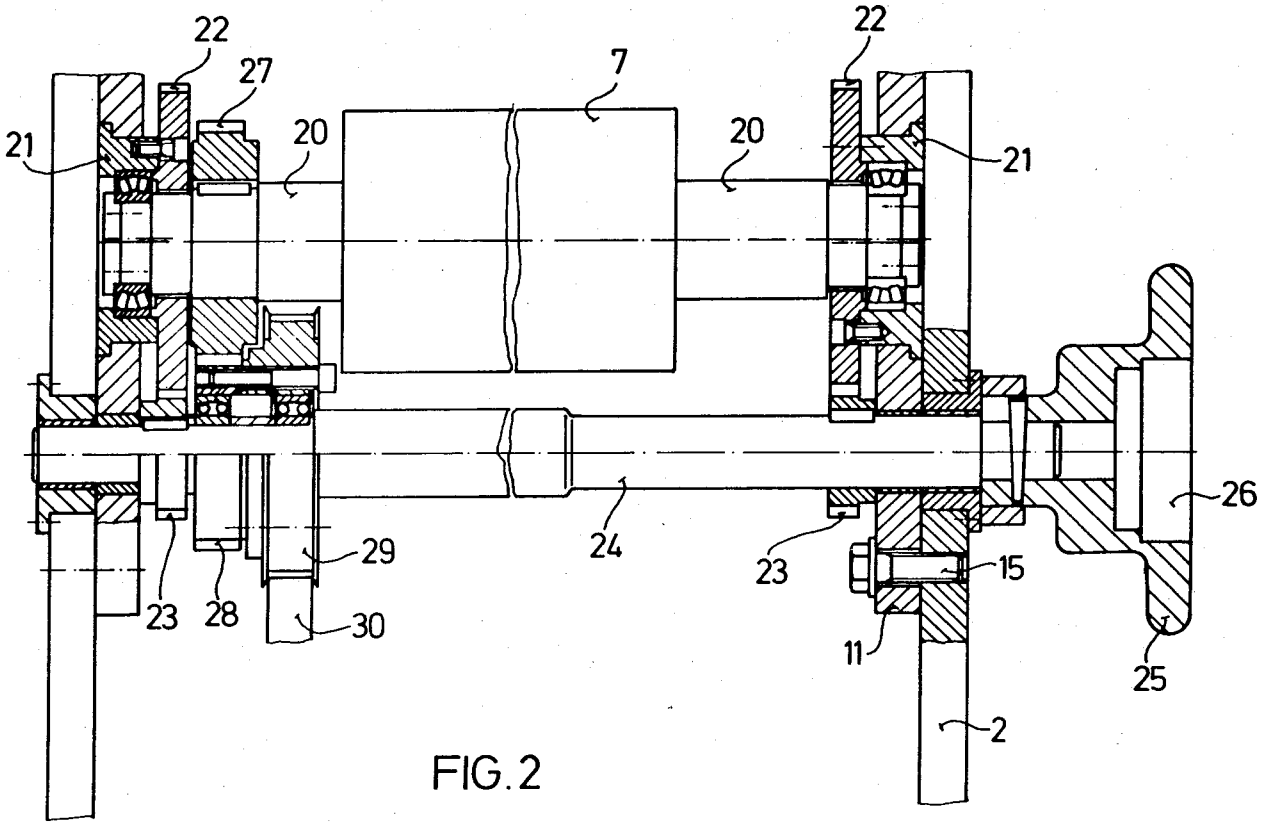

Further expedient embodiments and advantageous further developments of the generic measures can be obtained from the description which follows of an example embodiment in conjunction with the remaining sub-claims and with reference to the drawing, wherein:

FIG. 1 shows a vertical section through an apparatus according to the invention with an inserted form cylinder, and FIG. 2 shows a section along line II/II in FIG. 1.

The apparatus shown in FIG. 1 consists of a machine frame which has two lateral side walls 2 which are connected to one another by traverses 1 and are provided with a slot-shaped insertion aperture 3 which is open on one side, is arranged at about half the height of the side walls 2 and is intended for the insertion of the lateral bearing journals 4 of a form cylinder 5 to be lined with a wrap-around plate. The insertion aperture 3 in the area of each side frame 2 can be closed by means of a closure bracket 6, which can be removed or swung away, in such a way that the inner area of the insertion aperture 3 forms a pivot bearing for the allocated bearing journal 4 of the form cylinder 5.

A pressing roller 7 is provided for pressing and clamping the wrap-around plate to be firmly placed onto the form cylinder, which in the present case is to be a form cylinder for gravure printing, which pressing roller 7 can be placed against the periphery of the form cylinder 5 and can be driven by means of a motor 8. The form cylinder 5 is here provided with a cavity formed by a slot 9 running parallel to the axis on the periphery side. The wrap-around plate to be attached is simply hung with its bent-over edges at the border of the cavity and then rolled on by means of the pressing roller 7, the bent-over border edges of the wrap-around plate then also being pressed into the slot forming the cavity 9. The pressing roller 7 is provided with a rubber lining to protect the wrap-around plate.

To ensure a format setting, that is an adaptation of the position of the pressing roller 7 to the diameter of the particular form cylinder 5, the pressing roller 7 is accommodated on a swivel frame which is designated as a whole as 10 and is mounted on the machine frame side walls 2 to pivot about an axis located outside the insertion aperture 3. The swivel frame 10 has lateral bearing plates 11 which are parallel to the machine frame side walls 2 and on which is mounted the pressing roller 7. In the operating position, the bearing plates 11 and thus the entire swivel frame 10 are fixed to the machine frame side walls 2. For this purpose, threaded holes 13 arranged with the same mutual spacing are provided in the area of each side wall 2 on a pitch circle 12 drawn about the swivel axis of the swivel frame 10. The bearing plates 11 of the swivel frame 10 are each provided with an elongated hole 14 which is located on the same pitch circle 12 and through which can be inserted a fixing screw 15 which can be screwed into a selected threaded hole. The mutual spacing of the threaded holes 13 is slightly smaller than the length of the allocated elongated hole 14, so that the elongated hole 14 can extend over two adjacent threaded holes 13, which ensures an infinitely variable adjustability of the swivel frame 10. A lifting device 16 is allocated to the swivel frame 10 to ensure simple handling. In the example of embodiment shown, this lifting device 16 consists of a threaded spindle 18 which is pivotably supported on the machine frame side, is provided with a drive wheel 17 and engages into an allocated threaded bush 19 fixed to the swivel frame 10. It would also be conceivable to swivel the swivel frame 10 manually. In the example of embodiment shown, one bearing plate 11 is also provided with an additional drilled hole 31, into which engages a pin 32, fixed to the machine frame, in order to effect a particularly reliable mounting.

The swiveling capacity of the swivel frame 10 in practice permits a rough adjustment of the pressing roller 7. To ensure fine adjustment, in other words to ensure exact adjustability of the required contact force of the pressing roller 7, the latter, as can best be seen from FIG. 2, is accommodated by its lateral bearing journals 20 in eccentric bushes 21 which are rotatably arranged on the bearing plates 11 of the swivel frame 10. By rotation of the eccentric bushes 21, the pressing roller 7 can be adjusted further when the swivel frame 10 is already fixed, by which means the contact force acting on the allocated form cylinder 5 can be adjusted exactly. If the form cylinder 5 has a large diameter, a comparatively large contact surface is obtained between the form cylinder 5 and the pressing roller 7. The size of this contact surface also reduces with the cylinder diameter. However, the same surface pressure is nevertheless to come into effect in each case when rolling on a wrap-around plate. This can easily be achieved by adjusting the eccentric bushes 21.

The eccentric bushes 21, as can also be seen from FIG. 2, are each provided with an integrally formed or, as here, attached gear rim 22 which engages into a respectively allocated pinion 23. The pinions 23 allocated to the two eccentric bushes 21 are keyed onto a continuous regulating spindle 24 which is mounted in the machine frame side walls 2 and is provided with a handwheel 25 in the area of the outside of the machine frame. The handwheel 25 can be provided with a position indicator device 26, on which the set contact pressure can be read off.

The regulating spindle 24 at the same time forms the axis of rotation of the swivel frame 10, the lateral bearing plates 11 of which are mounted hereupon by means of allocated bearing bushes. In this arrangement, the regulating spindle 24 is allotted a double function which facilitates the adjustability of the eccentric bushes 21 despite the adjustability of the swivel frame 10.

A pinion 27 keyed onto a lateral bearing journal 20 is provided for driving the pressing roller 7, which pinion 27 engages into an allocated spur gear 28 which is mounted to rotate freely on the regulating spindle 24 forming the swivel frame axis of rotation and is firmly connected to a laterally attached belt pulley 29 which is connected by means of an allocated belt 30 to the drive motor 8 fixed to the machine frame on a traverse 1. At the same time, therefore, the regulating spindle 24 also forms an axis of the drive transmission allocated to the pressing roller 7 and formed by the spur gear 28 and the belt pulley 29. This ensures that the pressing roller 7 can be driven in practice at every setting of the swivel frame 10 and every setting of the eccentric bushes 21 by means of the motor 8 fixed to the machine frame. The toothing of the pinion 27 and of the allocated spur gear 28 is selected in such a way that reliable engagement is ensured in every position of the eccentric bushes 21. This is easily possible, because, as a result of the positional adjustability of the swivel frame 10, a comparatively small eccentricity of the eccentric bushes 21 is sufficient to be able to set the required contact force.

The wrap-around plate to be attached to the form cylinder 5, as stated previously, is rolled onto the form cylinder 5 by means of the pressing roller 7 and is thus brought into the clamping position. Following the rolling-on operation, the clamping jaws allocated to the wrap-around plate edge catches engaging into the cavity 9 can then be adjusted is so far as such adjustability is provided. However, it may also be sufficient to make the cavity 9 simply in the form of an oblique slot, into which the edge catches of the wrap-around plate are pressed by means of the pressing roller 7 after the rolling-on operation has ended. After the wrap-around plate has been brought into position in this way, the cavity 9 must be closed in the case of a form cylinder for gravure printing. For this purpose, the cavity 9 is filled as a rule with a plastic, hardening substance. This can be effected with a separate apparatus. In the example of embodiment shown, a work station is provided for this purpose which is arranged on the side of the insertion aperture 3 opposite the swivel frame 10, by which means re-clamping of the form cylinder 5 is avoided.

The cavity 9 is filled in the manner of an injection molding die. For this purpose, connecting nipple for a charging line are provided, arranged in the area of the lateral cavity covers. The cavity cross-section on the periphery side is covered by means of a plate 33, which is pressed against the cylinder periphery. As shown by FIG. 1, a pressing beam 34 which engages over the plate 35, which can expediently consist of a transparent, flexible material, and is continuous over the entire machine width is provided for this purpose, which pressing beam 34, with its lateral ends, engages in guides 35 provided in the area of the machine frame side walls 2, which guides 35 run radially with respect to the rear area of the insertion aperture 3, which area forms a pivot mounting for the bearing journals 4 of the form cylinder 5. The pressing beam 34 is made as an encircling box frame which has two parallel pressure bars 36, which are continuous over the machine width, and two webs 37 which connect the two pressure bars 36 to one another in the area of their ends and on which engages an allocated lifting device 38. The inner edges of the cylinder-side surfaces of the pressure bars 36, which edges are expediently rounded to protect the plate, result in pressing edges, by means of which the curvature of the area of the plate 33 which engages over the periphery-side cross-section of the cavity 9 can be exactly adapted to the cylinder curvature. In the present case, this takes place simply in that the plate 33 is pressed against the cylinder periphery virtually with its entire width.

The lifting device 38 allocated to the pressing beam 34 consists of two regulating members 39 which can be actuated synchronously, engage in each case on the webs 37 via a toggle lever arrangement, are supported on the machine frame side and are here made in the form of cylinder-piston units working with compressed air. The toggle lever arrangement provided between the regulating member 39 and the allocated web 37 comprises two brackets 40 and 41 which are connected to one another in an articulated manner, of which one is articulated on the allocated web 37 and the other on the adjacent machine frame side wall 2. The bracket 40 articulated on the web side is made as an interchangeable part and can be exchanged for longer or shorter brackets to adapt the working position of the pressing beam 34 to the diameter of the form cylinder 5. A further adaptation within a narrower framework could also be achieved in that the brackets 40 and 41 can be optionally articulated to one another at several locations. For this purpose, one of the brackets, expediently the bracket 41 articulated on the machine frame side, could be provided with several bearing holes 42. At the same time, the length of the interchangeable bracket 40 and the bearing hole 42 to be covered in each case are selected in such a way that the toggle lever arrangement in the contact position comes approximately into the extended position. The greatest contact force is obtained in this position, in which the axes of the three joints lie in a straight line. It should also be mentioned in this connection that the length of the guide 35 is selected so that the pressing beam 34 is reliably guided in each case, that is independently of the diameter of the form cylinder 5. Moreover, a stop 43 can be provided for the pressing beam 34. The bracket 41 articulated on the machine frame side does not need to be interchangeable. The allocated regulating member 39 therefore expediently engages on this bracket. To be able to set the pressing beam 34 exactly parallel to the cylinder surface, a joint pin of the three joints of each toggle lever arrangement is in each case made as an adjustable eccentric pin. In the example of embodiment shown, the bracket articulated on the machine frame side is articulated on the respectively allocated side wall 2 by means of an adjustable eccentric pin 44, by which means good accessibility of the eccentric pin to be adjusted and thus excellent ease of operation are ensured.

In the example of embodiment shown, the pressing beam 34 and the guide 35 and lifting device 38 allocated thereto are located above the insertion aperture 3 allocated to the cylinder 5. The swivel frame 10 with the pressing roller 7 is arranged beneath this. This measure results in a neat and compact method of construction and simple operation.

After the cavity 9 has been filled with appropriate filler material, preparation of the form cylinder 5 is complete. The finished form cylinder can therefore be removed from the apparatus according to the invention and inserted into the allocated printing unit, here a gravure printing unit. The preparation of the form cylinder 5 outside the allocated printing unit thus clearly ensures a high printing unit utilization even when using wrap-around plates, in particular wrap-around gravure printing plates.

We claim:

1. Apparatus for lining a removable form cylinder, in particular a form cylinder for gravure printing, with a wrap-around plate, comprising a machine frame having insertion apertures (3), provided in the area of its side walls (2) and allocated to the lateral bearing journals (4) of the form cylinder (5), and having a swivel frame (10) which is pivotably mounted outside the insertion apertures (3), can be fixed in every required pivotal position relative to the machine frame and accommodates a drivable pressing roller (7) mounted in rotatable eccentric bushes (21).

2. Apparatus as claimed in claim 1, wherein in each case several threaded holes (13) arranged on a pitch circle (12) with respect to the axis of rotation of the swivel frame (10) are provided in the area of the machine frame side walls (2), and the swivel frame (10) has two lateral bearing plates (11) which each have an elongated hole (14) arranged on the same pitch circle (12), the length of which elongated hole (14) is greater than the distance between two adjacent threaded holes (13).

3. Apparatus as claimed in claim 1, wherein the swivel frame (10) can be swiveled by means of a lifting device (16) which preferably has at least one threaded spindle (18) which is pivotably supported on the machine frame side, is provided with a drive wheel (17) and engages into an allocated threaded bush (19) fixed on the swivel frame side.

4. Apparatus as claimed in claim 1, wherein the eccentric bushes (21) rotatably mounted on the bearing plate side and accommodating the lateral bearing journals (20) of the pressing roller (7) are each provided with a gear rim (22) which engages in a pinion (23) fixed on a spindle (24) forming the swivel axis of the swivel frame (10) and rotatably mounted on the machine frame side.

5. Apparatus as claimed in claim 4, wherein the spindle (24) is provided with a drive wheel (25) having a position indicator (26).

6. Apparatus as claimed in claim 1, wherein the pressing roller (7) can be drivable by means of a pinion (27) which is keyed onto a lateral bearing journal (20) and meshes with a spur gear (28) which is rotatably mounted on the spindle (24) forming the axis of rotation of the swivel frame (10) and can be driven by means of a motor (8) fixed on the machine frame side.

7. Apparatus as claimed in claim 6, wherein the spur gear (28) rotatably mounted on the spindle side is provided with a laterally attached drive wheel (29) which is connected to the motor (8) via a transmission element (30).

8. Apparatus as claimed in claim 1, wherein the insertion apertures (3) provided in the area of the side walls (2) and open on one side can each be closed by means of an allocated closure bracket (6).

9. Apparatus as claimed in claim 1, wherein the pressing roller (7) has a rubber jacket.

10. Apparatus as claimed in claim 1, wherein the machine frame side walls (2) are provided with guides (35) which are provided opposite one another in the area outside the swivel frame (10) and run in the radial direction with respect to the inner end of the insertion apertures (3), which inner end forms a journal bearing, in which guides (35) is displaceably mounted a pressing beam (34) which extends over the entire machine width and can be displaced by means of a lifting device, by means of which pressing beam (34) a molding which covers the cylinder cavity (9) and is preferably made as a transparent plate (33) can be pressed against the periphery of the form cylinder (5).

11. Apparatus as claimed in claim 10, wherein the pressing beam (34) is made in the form of an encircling box frame having two parallel pressure bars (36), extending over the machine width, and two or more webs (37) running transversely thereto, on which the lifting device (38) engages.

12. Apparatus as claimed in claim 10, wherein the box frame forming the pressing beam (34), via toggle lever arrangements engaging on its webs (37), is suspended at the machine frame by a bracket (40) articulated on the pressing beam side and preferably made as an interchangeable part, and by a bracket (41) which is connected in articulated manner to the bracket (40), is articulated on the machine frame side preferably by means of an eccentric pin (44) and can be actuated by an allocated regulating member (39) supported on the macine frame side.

13. Apparatus as claimed in claim 1, wherein the swivel frame (10) supporting the pressing roller (7) is arranged beneath the insertion apertures (3) on the machine frame side and the guides (35) accommodating the pressing beam (34) is arranged above the insertion apertures (3) on the machine frame side.

* * * * *